United States Patent [19]

Hirosawa

[11] 4,022,551

[45] May 10, 1977

[54] VARIABLE CAPACITY TYPE GEAR PUMP

[75] Inventor: Shingo Hirosawa, Yokohama, Japan

[73] Assignee: Aikoh Co., Ltd., Tokyo, Japan

[22] Filed: Nov. 6, 1975

[21] Appl. No.: 629,250

Related U.S. Application Data

[63] Continuation of Ser. No. 368,091, June 8, 1973, abandoned.

[30] Foreign Application Priority Data

June 13, 1972 Japan ..... 47-58181

[52] U.S. Cl. ..... 417/440; 418/206; 137/569; 137/625.48

[51] Int. Cl.[2] ..... F04B 49/00; F04C 1/08

[58] Field of Search ..... 417/304, 440, 310; 60/468, 494; 137/625.12, 625.4, 625.48, 569; 418/191, 206, 159, 205

[56] References Cited

UNITED STATES PATENTS

| | | | |
|---|---|---|---|
| 1,481,358 | 1/1924 | Dwyer | 417/440 |
| 2,424,750 | 7/1947 | Heckert | 418/180 |
| 2,630,759 | 3/1953 | Mahlon | 417/310 |
| 2,676,462 | 4/1954 | Berry | 418/180 |
| 2,820,416 | 1/1958 | Compton | 418/180 |
| 3,824,041 | 7/1974 | Rystrom | 417/410 |

FOREIGN PATENTS OR APPLICATIONS

| | | | |
|---|---|---|---|
| 157,744 | 10/1932 | Switzerland | 418/180 |
| 420,501 | 12/1934 | United Kingdom | 417/440 |

*Primary Examiner*—John J. Vrablik
*Attorney, Agent, or Firm*—Fay & Sharpe

[57] ABSTRACT

This invention relates to a variable capacity type gear pump which is capable of operating efficiently by flowing out by-passed liquid under extremely low pressure to adjust or control the amount of feed-out liquid. This is accomplished by providing the walls of the casing (housing) of the gear pump with ports or slits, which ports or slits are connected to a controlling valve in order to remove the desired amount of by-passed liquid.

1 Claim, 4 Drawing Figures

VARIABLE CAPACITY TYPE GEAR PUMP

This is a continuation, of application Ser. No. 368,091, filed June 8, 1973, now abandoned.

This invention relates to a variable capacity type gear pump.

In conventional gear pumps, there has been no other way than to vary the number of rotations of the pumps in order to vary the amount of feed-out of the exhaust liquid without a loss of the pressure liquid. In general, in order that the feed-out amount or the feed-out pressure of the exhaust liquid is varied, it is a custom that a part of the pressure liquid in the feed-out pipe line is by-passed and that the by-passed part of the liquid is returned either to a reservoir of the liquid or to a liquid suction side of the pump. Under such a process, there is a loss of energy possessed by the pressure liquid, that is the liquid power, so that the pumping efficiency is remarkably lowered.

Therefore, the object of this invention is to overcome the above mentioned defects and to provide a gear pump which is capable of operating with high pumping efficiency by flowing out the forcedly by-passed liquid under extremely low pressure to adjust the feed-out amount of the liquid.

According to the present invention there is provided a variable capacity type gear pump characterized by being structured in such a manner that the wall of a pair of pump casing which correspond with the surfaces of the addendum circle of gears are provided with several ports of slits for liquid by-pass, said walls are connected with a suitable controlling valve by means of said ports or slits, said ports or slits for liquid by-pass are opened in regular succession from a suction side to an exhaust side through the operation of said controlling valve, and the liquid feed-out amount of the pump is varied by flowing back the liquid enclosed among the gear teeth, under low pressure, to a liquid reservoir or a suction pipe.

In general, the instant invention relates to a variable capacity gear pump which comprises a pair of rotatably mounted generally cylindrical gear members having teeth on the outer periphery thereof which at least partially engage each other; a housing having an inlet port and an outlet port which is positioned in close proximity to the outer surfaces of said gears (addendum circle of said gears) encasing said gears, with said housing having a plurality of openings (ports) therein; and means communicating with said openings in said housing whereby fluid can be removed from the inner portion of said gear pump housing as desired.

In one embodiment of the invention, the variable capacity gear pump has a housing which consists of a first casing segment which encloses one gear member and a second casing segment which encloses the other gear member. If desired, the first and second casing segments are fabricated in such a manner that flanges extend from each segment which flanges then form inlet and outlet ports for the concerned gear pump assembly.

The invention will now be described by way of example only and with reference to the accompanying drawings in which.

Figure 1:
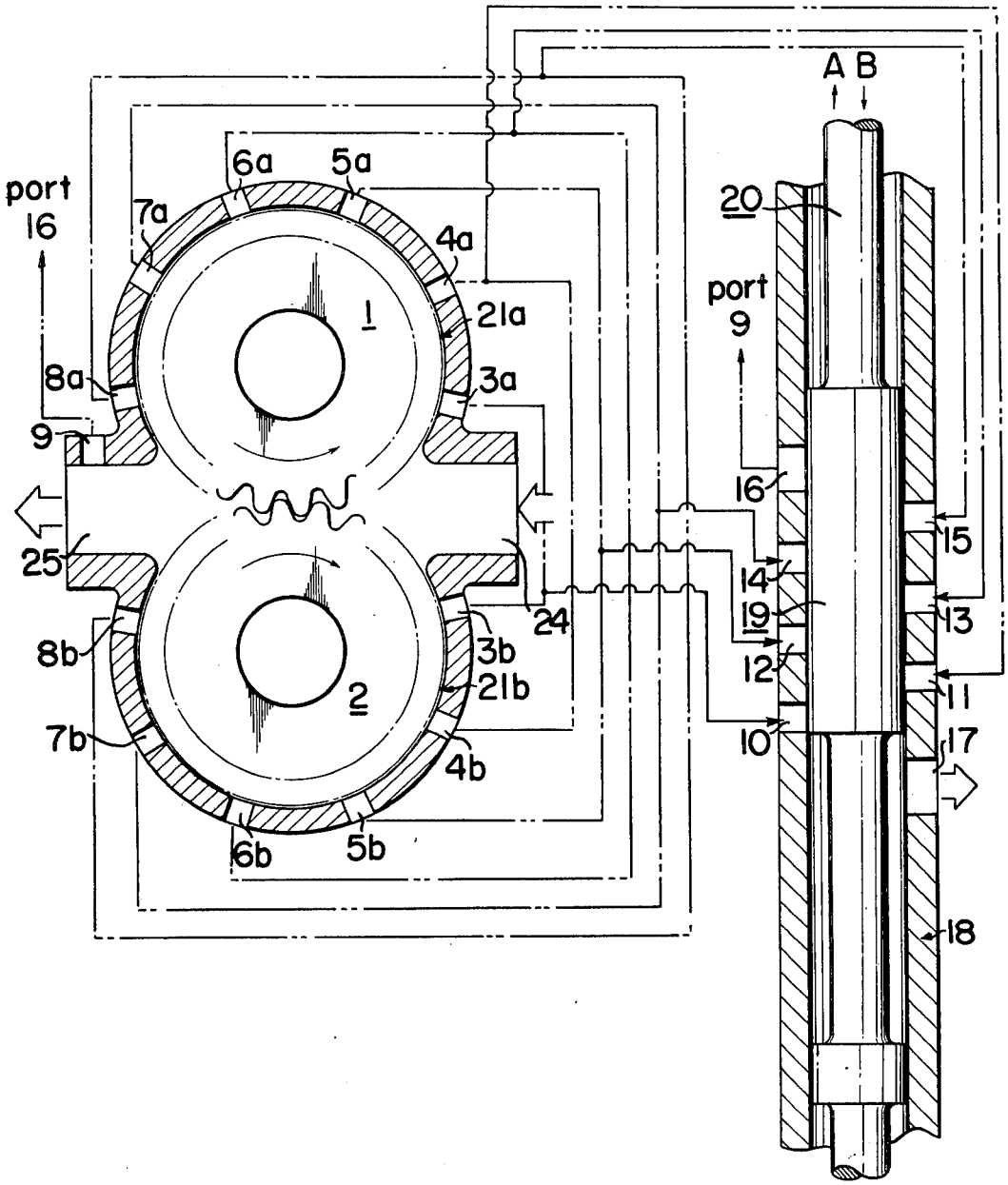
FIGS. 1 to 3 are respectively a longitudinal sectional view showing different embodiments of the variable capacity type gear pump according to the invention.

Referring to the drawings, FIG. 1 explains the principle of the invention by way of an embodiment. In the wall of a pump casing (first casing segment) which corresponds with a gear 1 there are provided several liquid by-pass ports or slits 3*a*, 4*a*, 5*a*, 6*a*, 7*a* and 8*a*, and similarly in the wall of another pump casing (second casing segment) which corresponds with another gear 2 there are other several liquid by-pass ports or slits 3*b*, 4*b*, 5*b*, 6*b*, 7*b* and 8*b*. These ports or slits for by-pass are connected to a controlling valve means 18 by pipes or conduits. In the embodiment illustrated in FIG. 1, each pair of the liquid by-pass ports or slits 3*a* and 3*b*, 4*a* and 4*b*, 5*a* and 5*b*, 6*a* and 6*b*, 7*a* and 7*b*, and 8*a* and 8*b*, which are in relative position respectively, are connected by their respective pipes (shown as dot-dashed lines). In turn, each pipe is now coupled with the appropriate ports 10, 11, 12, 13, 14 and 15 of said control valve 18 by other respective pipes (also shown as dot-dashed lines). In case a required amount of by-pass liquid is not obtained even if all the by-pass ports or slits might be opened, still another by-pass port 9 is provided at the feed-out port which is coupled by a pipe or conduit with port 16 of said control valve means 18.

Figure 4:
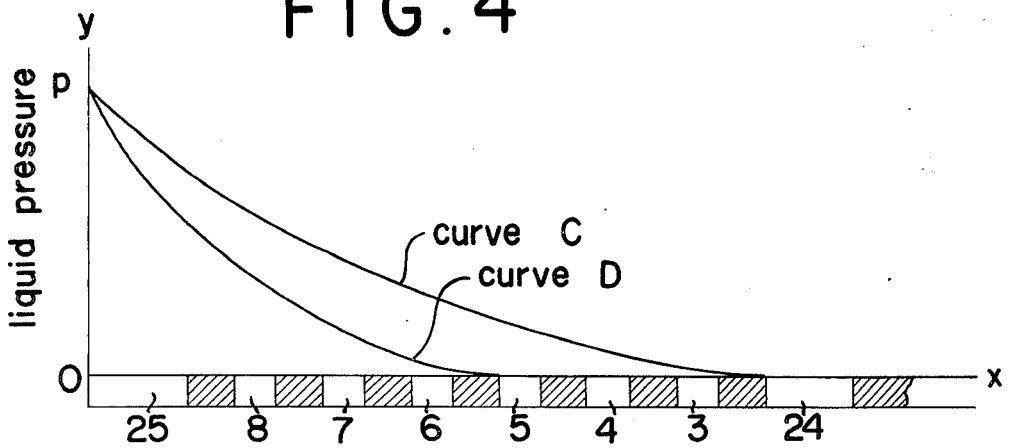
FIG. 4 shows efficiency curves in which X-axis express the developing of the semi-cylindrical walls of pump casings, which correspond to the surface of the addendum circle of the gear teeth of the present invention, and in which Y-axis expresses the distributing conditions of liquid pressure in the clearances at the top of gears.

In case all the ports or slits for by-pass are closed by the control valve 18 while operating the gear pump, there are top clearances 21*a* and 21*b* between the surfaces of addendum circle of said gears and the inwalls of said pump casings (or housing), and some portion of the pressure liquid at the feed-out port leaks into the suction side through these top clearances. Accordingly, as shown in FIG. 4, the pressure distribution in the top clearances is as Curve C. In FIG. 4, the X-axis shows the developed walls of the semi-cylindrical pump casings, and the Y-axis the liquid pressure. The reference numerals 3 to 8 show the positions of the ports or slits for by-pass respectively.

Referring to FIG. 1, if the control valve 18 moves in the direction of the arrow A, a port 10 of said control valve opens, and a by-passing of the liquid starts from the by-pass ports or slits 3*a* and 3*b* provided at the walls of the pump casings (which together constitute the pump housing). As shown in FIG. 4, at the ports or slits 3*a* and 3*b* the liquid is under an extremely low pressure, and the flow-out of said liquid from the ports or slits for by-pass will be effectively carried out owing to the difference between the low pressure and the pressure in the liquid reservoir or a suction pipe and by means of the centrifugal force occurred by the liquid making a circular motion with the gear teeth. It is added that the reference numeral 17 is a discharge port leading to the liquid reservoir (not shown in drawings); 19 a cylinder valve; 20 a rod; 24 a suction port (or inlet) and 25 a flow-out port (or outlet), respectively.

If the controlling valve 18 further moves in the direction of the arrow A, there is carried out in regular succession the by-passing (or removal) of the liquid enclosed among the gear teeth under the low pressure conditions as in the case of each pair of the liquid by-pass ports or slits 4*a* and 4*b*, 5*a* and 5*b* and the like. The Curve D in FIG. 4 shows the state of the pressure distribution of said top clearances 21*a* and 21*b* under the circumstances wherein the liquid by-pass ports or slits 3 to 5 are open and the liquid by-pass ports or slits 6 to 8 are closed. It will be known from the Curve D that when each by-pass port or slit is open the liquid would flow away under low pressure.

The liquid enclosed among the gear teeth near the suction port 24 is by-passed in regular succession as stated above, but the liquid amount decreased by the by-passing is gradually replenished due to the liquid leaking from said feed-out port 25 of the pump to the suction side through the top clearances 21*a* and 21*b*.

Figure 2:
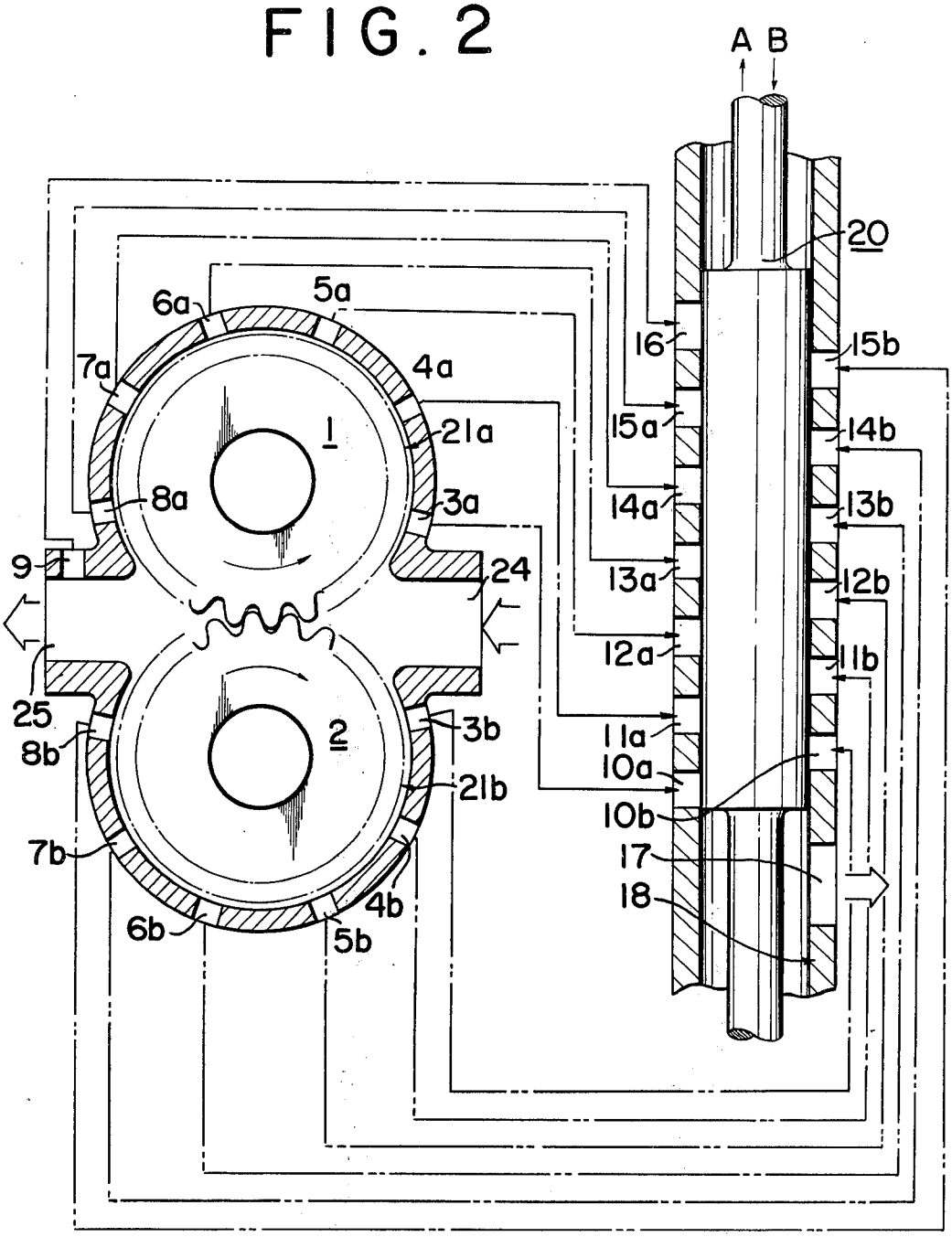

FIG. 2 illustrates the other embodiment in which the by-pass ports or slits provided at the surfaces of said pump casings (housing) which correspond with the surfaces of the addendum circles of both the gears 1 and 2 are directly guided to each corresponding port of said control valve 18 by means of pipes (shown as dot-dashed lines). If construction be made in such a manner, it is possible to make the change of the amount by which the liquid is by-passed continuously.

In case it is all right that the change of the amount of liquid feeding-out of said pump is in the range from the maximum amount up to over ½ of the maximum amount, it will suffice that the ports or slits for by-pass are provided at only the wall of the pump casing corresponding to either of a pair of the gears 1 and 2, and those at the wall of the other pump casing corresponding to the other gear are dispensed with.

As regards the force caused by the feed-out of the liquid from the ports for by-pass, the force by the centrifugal force produced through the circular motion of the liquid enclosed among said teeth is by far greater than that caused by the pressure difference before and behind the ports or slits for by-pass. Accordingly, said ports or slits for by-pass in the embodiments shown in FIGS. 1 and 2 can achieve their object even if they have a small area. In this connection, the pipes which connect the ports for by-pass with the control valve may be unobjectionably of smaller bore or smaller cross-sectional area, so that the construction of the pump becomes simpler.

The required amount of the liquid flown out from the ports or slits for by-pass makes maximum the liquid amount enclosed among the gear teeth during the period when the teeth move from the suction port 24 to the feeding-out port 25. In this respect, in the case of somewhat greater areas of the ports or slits for by-pass and in the case of greater circumferences of the gears and greater centrifugal force of the liquid, the by-pass ports provided in the pump casings (housing) will suffice with several ports near the suction side. For example, in case the required liquid amount is flown out at the three portions of said by-pass ports 3, 4 and 5 in FIG. 4, the by-pass ports 6, 7, 8 and 9 can be omitted.

Figure 3:
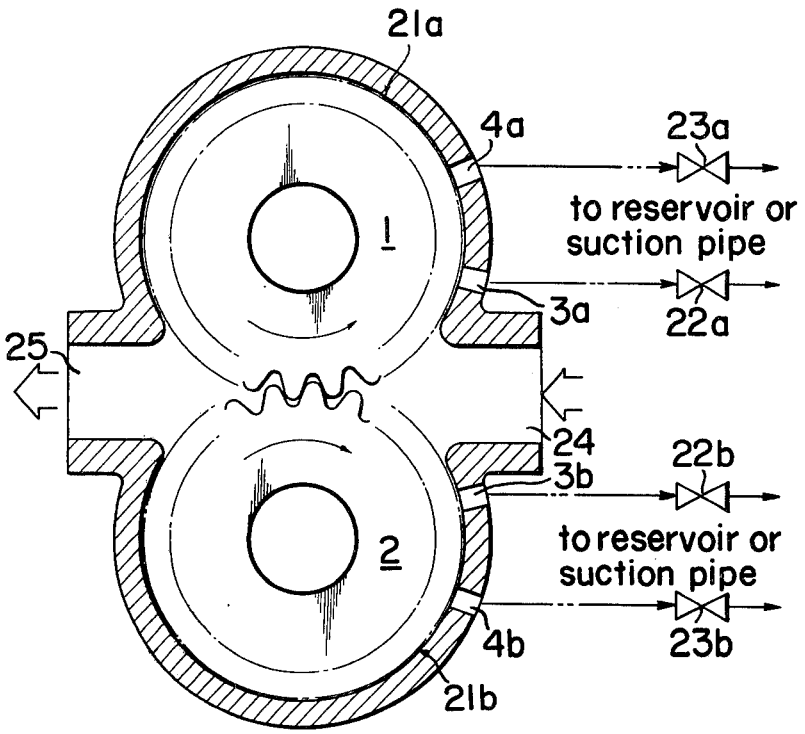

If the areas of the by-pass ports or slits are made larger, and at the same time one or a few by-pass ports or slits are provided in the neighborhood of said suction port 24, as shown in FIG. 3, it will be possible to flow out the maximum liquid amount required. In this case, the ports or slits for by-pass are connected with said controlling valve 18 which is capable of adjusting the flow amount, and the necessary by-passing amount is regulated by said controlling valve. FIG. 3 shows an alternative embodiment in which two ports or slits for by-pass are provided in each sectional wall of the pump casings (housing). In addition, controlling valves 22*a*, 22*b*, 23*a*, 23*b* may be arranged in one or several (joint or individual).

As hereinabove described, the present invention is concerned with an efficient variable capacity type gear pump in which the liquid enclosed among the gear teeth is flown out under low pressure from the ports or slits for by-pass provided at the walls of the pump casings which correspond with addendum circle, and the centrifugal force possessed by the liquid is utilized for said feeding-out so as to make the loss of the driving force minimum.

What I claim is:

1. A variable capacity gear pump having a low pressure suction side and a high pressure feed out side comprising:

a pair of circumferentially intermeshing gears operatively connected in the pump;

a pair of pump casings around the gears having walls which generally correspond to the surfaces of the addendum circles of the gears and include an inlet port at the suction side and an output port at the feed out side; both of the pump casings further including at least five pressure relief ports substantially equally spaced around the periphery of each of the pump casings from the low pressure suction side to the high pressure feed out side, each port on each casing having a correspondingly placed port on the other casing so that the ports are paired, the ports passing through said walls to facilitate selective fluid by-pass therethrough;

means for selectively controlling liquid flow operatively coupled with said ports in order to vary the amount of liquid feeding out of the pump at high pressure, the means for selectively controlling including a control valve having a cylinder having a series of inlet ports, a discharge port and a rod in the cylinder to control the fluid paths between the inlet ports and the discharge port; each of said inlet ports on said control valve being operatively connected to at least one of the pressure relief ports, the inlet ports being operatively connected to sequentially open at least one of the pressure relief ports of each pair and then the other pressure relief port of the same pair starting from the pair on low pressure suction side and ending with the pair on the high pressure feed out side and closing in the reverse order so that the low pressure fluid can be initially discharged from the pump when a lower volume feed out is desired without the necessity of raising the discharged fluid to a high pressure.

* * * * *